United States Patent [19]

Umehara et al.

[11] 4,432,924

[45] Feb. 21, 1984

[54] PROCESS FOR PRODUCING AN ELECTRICALLY CONDUCTIVE MONOFILAMENT

[75] Inventors: Kenji Umehara, Funabashi; Hiroshi Takeda, Narashino; Susumu Tomidokoro, Funabashi, all of Japan

[73] Assignee: Lion Corporation, Tokyo, Japan

[21] Appl. No.: 366,995

[22] Filed: Apr. 9, 1982

[30] Foreign Application Priority Data

Apr. 10, 1981 [JP] Japan ..... 56-54082
Jun. 12, 1981 [JP] Japan ..... 56-90302

[51] Int. Cl.[3] ..... D01D 5/12

[52] U.S. Cl. ..... 264/210.8; 264/211; 264/290.5

[58] Field of Search ..... 428/372, 244, 347; 264/171, 210.8, 168, 288.8

[56] References Cited

U.S. PATENT DOCUMENTS

| | | | |
|---|---|---|---|
| 3,215,486 | 11/1965 | Hada et al. | 264/288.8 |
| 3,513,110 | 5/1970 | Noether | 264/210.3 |
| 3,706,195 | 12/1972 | Davis et al. | 57/140 |
| 3,803,453 | 4/1974 | Hull | 317/2 R |
| 3,969,559 | 7/1976 | Boe | 428/87 |
| 4,085,182 | 4/1978 | Kato | 264/176 F |
| 4,145,473 | 3/1979 | Samuelson et al. | 428/397 |
| 4,207,376 | 6/1980 | Nagayasu et al. | 428/397 |
| 4,217,323 | 8/1980 | Foster et al. | 264/235 |
| 4,338,276 | 7/1982 | Carr | 264/176 F |
| 4,369,155 | 1/1983 | Schilo et al. | 264/210.8 |

FOREIGN PATENT DOCUMENTS

| | | | |
|---|---|---|---|
| 2741193 | 3/1979 | Fed. Rep. of Germany | 264/210.8 |

*Primary Examiner*—Jay H. Woo
*Attorney, Agent, or Firm*—Armstrong, Nikaido, Marmelstein & Kubovcik

[57] ABSTRACT

An electrically conductive thermoplastic resin monofilament having a high mechanical strength and an excellent electrical conductivity is produced. This monofilament containing an electrically conductive carbon black is produced through extrusion, cooling, aging, and orientation steps, the temperature of the monofilament in the orientation step is within the range of from 60° C. to 5° C. less than the melting point of the thermoplastic resin, and orientation is carried out at a stretching strain rate of 5000%/min or less. Also in the aging step the temperature is optionally kept constant.

3 Claims, 3 Drawing Figures

PROCESS FOR PRODUCING AN ELECTRICALLY CONDUCTIVE MONOFILAMENT

The present invention relates to a process for producing an electrically conductive monofilament. More specifically, it relates to a process for producing an electrically conductive monofilament having an excellent mechanical strength without causing a decrease in conductivity.

Recently, a thermoplastic resin monofilament containing an electrically conductive carbon black has become of major interest as a new electrically conductive material in the electrical and electronical fields, in related fields, and in fields involving the handling of flammable gas or liquid since it has excellent electrical characteristics.

The electrically conductive monofilament is generally formed by mixing electrically conductive carbon black powder with a thermoplastic resin in the form of a powder or pellet, followed by an extrusion step. Examples of the thermoplastic resin are polyamide, polyvinylidene chloride, polyvinyl chloride, polyethylene, polyester, and polystyrene.

Although the detailed production conditions and apparatuses of the extrusion step belong to a so-called know-how and, therefore, are not generally disclosed, steps as set forth in FIG. 1 are generally utilized. That is, referring to FIG. 1, a thermoplastic resin composition containing a carbon black is melted in an extruder 1 and is extruded from a die. The extrudate is then solidified in a cooling bath 2. The solidified monofilament thus obtained is orientated at a temperature below the melting point of the resin in an orientation vessel 3 since the strength of the extruded monofilament is not strong. The orientated monofilament is wound onto a bobbin in a winder 4. The cooling of the extrudate in the cooling bath 2 is generally carried out by means of air cooling, water cooling, or warm water-cooling. Orientation in the orientation vessel 3 is generally carried out by various conventional methods, for example, wet orientation, dry orientation, roll-heating orientation, and two-stage orientation methods, depending upon the kinds of resins and the intended usage of the products.

However, there is a disadvantage in the conventional processes in that the electrical conductivity of the monofilament undesirably decreases during the orientation step although the mechanical strength of the monofilament increases. For instance, according to the conventional processes, orientation is carried out under conditions in which the length of the orientation vessel is from 3 through 5 m, the stretching ratio is from 5 through 10, and the stretching rate is from 100 through 200 m/min. However, since the stretching strain rate during orientation under these conditions becomes from 6000 through 50,000% /min, a monofilament having the desired electrical conductivity cannot be obtained.

Accordingly, the objects of the present invention are to eliminate the above-mentioned disadvantages of the conventional processes for producing an electrically conductive monofilament and to provide a process for producing a monofilament having an excellent electrical conductivity and a high strength.

Other objects and advantages of the present invention will be apparent from the following descriptions.

In accordance with the present invention, there is provided a process for producing an electrically conductive thermoplastic monofilament containing an electrically conductive carbon black through extrusion, cooling, and orientation steps, wherein an aging step, in which the temperature of the monofilament is kept constant, is carried out between the cooling step and the orientation step.

In accordance with the present invention, there is also provided a process for producing an electrically conductive thermoplastic monofilament containing an electrically conductive carbon black through extrusion, cooling, and orientation steps, wherein the temperature of the monofilament in the orientation step is within the range of from 60° C. to 5° C. less than the melting point of the thermoplastic resin, and orientation is carried out at a stretching strain rate of 5000%/min or less.

The present invention will now be better understood from the following description given in connection with the accompanying drawings in which.

In the conventional orientation process, the temperature and stretching ratio in the orientation vessel may be controlled, in order only to afford the desired properties to a monofilament, and a precise control of the temperature at the beginning of orientation is required. However, the present inventors have found that, in order to obtain a monofilament having a high strength and an excellent electrical conductivity, the temperature of the monofilament at the beginning of orientation must be precisely controlled and the difference in the temperatures of the monofilament between the beginning and the end of orientation must be controlled. Contrary to this, according to the conventional processes and apparatuses, the cooled monofilament is gradually heated while orientation is started at a temperature below the predetermined orientation temperature. As a result, since a temperature gradient is produced between the temperature at the beginning of orientation and the temperature at the end of orientation, the electrical conductivity of the monofilament decreases.

However, according to the first embodiment of the present invention, no substantial decrease in the electrical conductivity of the monofilament occurs since an aging step is carried out between the cooling step and the orientation step.

Figure 2:
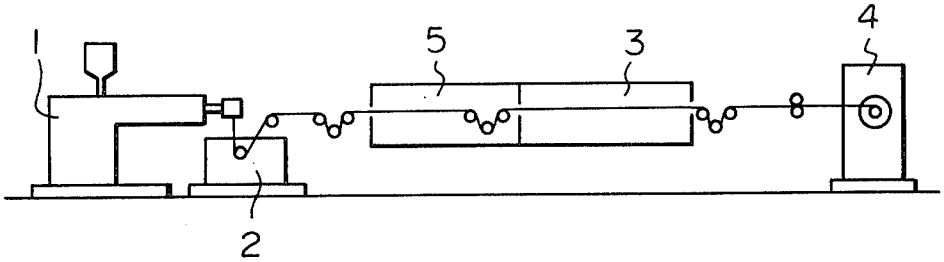
FIG. 2 is a schematic drawing illustrating a production flow sheet of one typical example of the production process of a monofilament according to one embodiment of the present invention.
Figure 3:
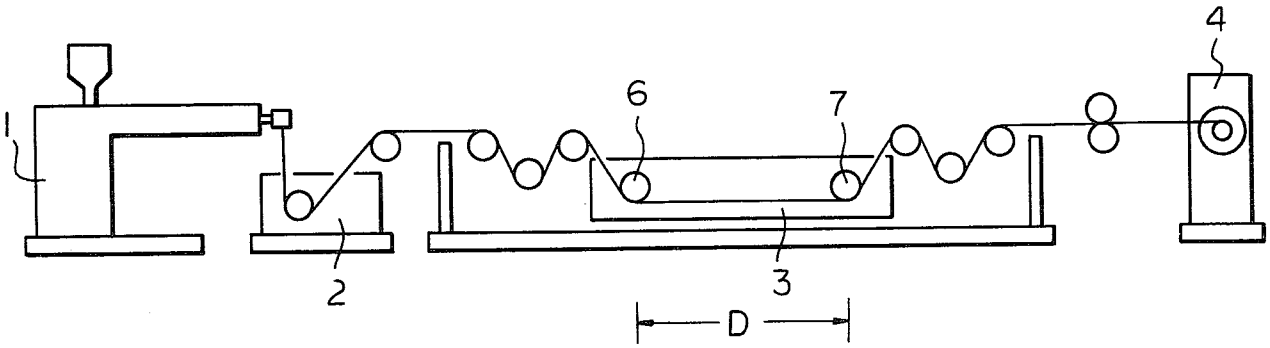
FIG. 3 is a schematic drawing illustrating a production flow sheet of one typical example of the production process of a monofilament according to another embodiment of the present invention.

As shown in FIG. 2, a thermoplastic resin composition containing an electrically conductive carbon black is melted in an extruder 1 and is extruded from a die. The Furthermore, as shown in FIG. 3, according to another embodiment of the present invention, a thermoplastic resin composition containing an electrically conductive carbon black is melted in an extruder 1 and is extruded from a die. The extrudate is then solidified in a cooling bath 2 to form a monofilament. The monofilament thus obtained and having an insufficient strength is fed into an orientation vessel 3 via the predetermined number of guide rolls. The monofilament is orientated between the first roll 6 and the second roll 7 in the orientation vessel 3. The orientated monofilament is wound by means of a winder 4 via the predetermined number of guide rolls.

The above-mentioned orientation should be carried out at a temperature of from 60° through 5° C., desirably from 50° through 5° C., less than the melting point of the resin forming the monofilament. The use of too high a temperature makes the forming of the monofilament difficult. The use of too low a temperature tends to decrease the electrical conductivity.

The above-mentioned orientation should also be carried out at a stretching strain rate of the monofilament of 5000%/min or less, desirably from 100 through 5000%/min.

The stretching strain rate (A) is represented by the following equation:

$$A = \frac{B \times C}{D}$$

wherein B is the elongation (%) which can be obtained from the equation, B=(stretching ratio-1)×100;

C is the stretching velocity (m/min) and is the difference ($V_2$–$V_1$) between the second roll speed ($V_2$) and the first roll speed ($V_1$); and D is the distance (m) between the first roll 5 and the second roll 6 in the orientation vessel 3.

In the case where the stretching strain rate of the monofilament is more than 5000%/min, a monofilament having a good electrical conductivity cannot be obtained. A stretching strain rate of 5000%/min or less can be readily accomplished by adjusting at least one factor of the length of the orientation vessel, the stretching ratio, or the stretching velocity. These factors can be changed separately or simultaneously.

Examples of the thermoplastic resins usable in the present invention are poly(butylene terephthalate), poly(ethylene terephthalate), polyamide, polypropylene, low-density polyethylene, high-density polyethylene, polystyrene, polyvinyl chloride, and polyvinylidene chloride. These resins can be used alone or in any mixtures thereof. The resins may be in any form, including pellets, granulates, or powder.

The electrically conductive carbon black usable in the present invention can be selected from any carbon black conventionally used in the production of electrically conductive resin compositions. Examples of such carbon black are acetylene black, electrically conductive furnace black, and electrically conductive by-produced carbon blacks. Especially desirable carbon black usable in the present invention is furnace black and by-produced carbon blacks having an oil absorption, in terms of dibutyl phthalate absorption amount (which is referred to as "DBP value or amount" hereinbelow), of 300 ml/100 g or more.

The amount of the electrically conductive carbon black contained in the electrically conductive thermoplastic resin monofilament varies depending upon the types of resins and the carbon black used. For example, in the case of furnace black, from 3 through 20 parts by weight, desirably from 4 through 15 parts by weight, based on 100 parts by weight of the resin, of furnace black is used. In the case of acetylene black, from 15 through 50 parts by weight, desirably from 20 through 35 parts by weight, based on 100 parts by weight of the resin, is used.

The thermoplastic resin compositions containing electrically conductive carbon black optionally include, for example, long fibrous reinforcing materials such as glass fiber and asbestos fiber, pigments, antistatic agents, lubricants, antioxidants, ultraviolet absorbers, and coupling agents.

As mentioned hereinabove, the electrically conductive monofilaments obtained by means of the present process have a high strength and an excellent electrical conductivity and, therefore, are suitable for industrial or practical use.

The present invention will now be further illustrated by, but is by no means limited to, the following Examples, wherein all parts are by weight unless otherwise noted.

EXAMPLES 1–4

One hundred parts of poly(butyrene terephthalate) having a melting point of 225° C. or Nylon 612 having a melting point of 210° C. was compounded with a commercially available electrically conductive furnace black having a DBP oil absorption amount of 350 ml/100 g in the amount listed in Table 1 below. The resultant composition was kneaded in a dual worm extruder to form pellets.

The pellets thus obtained were formed into a monofilament in the steps shown in FIG. 2. That is, the pellets were extruded from an extruder to form a monofilament and the temperature of the monofilament thus obtained was kept at the predetermined temperature listed in Table 1 below in a heating vessel 5 under no stretching conditions. After aging, the monofilament was orientated three times at the same temperature in an orientation vessel 3. Thus, monofilaments having a diameter of 0.8 mm were obtained.

The monofilaments thus obtained were cut into five pieces having a length of 15 cm and were bundled. Both ends of the bundled monofilaments were clipped with electrodes and a specific volume resistivity respresenting an electrical conductivity was determined according to the Wheatstone bridge method.

The forming conditions of the monofilaments and the specific volume resistivity are shown in Table 1 below.

TABLE 1

| | Example No. | | | |
|---|---|---|---|---|
| | 1 | 2 | 3 | 4 |
| Type of resin | PBT(2) | PBT | N-612(3) | N-612 |
| Amount of C.B.(1) (parts) | 4 | 6 | 7 | 9 |
| Temperature of heating and orientation vessels (°C.) | 185 | 185 | 180 | 180 |
| Specific volume resistivity of monofilament (Ohm-cm) | $1.5 \times 10^4$ | $2.1 \times 10^2$ | $3.4 \times 10^7$ | $7.2 \times 10^4$ |

(1)carbon black (manufactured by Lion AKZO)
(2)poly (butylene terephthalate)
(3)Nylon 612

COMPARATIVE EXAMPLES 1–5

Figure 1:
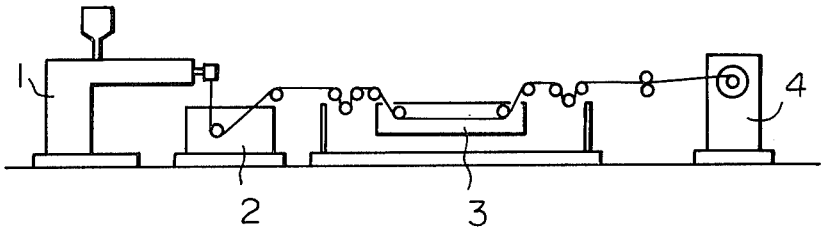
Fig. 1 PRIOR ART
FIG. 1 is a schematic drawing illustrating a production flow sheet of a typical conventional production process of a monofilament.

Monofilaments were prepared in a conventional apparatus as shown in FIG. 1 by using the same starting materials as in Examples 1 through 4. The stretching ratio was 3. Thus, monofilaments having a diameter of 0.8 mm were produced.

The specific volume resistivity of the monofilaments thus obtained was determined in the same manner as described in Examples 1 through 4. The forming conditions and the specific volume resistivity values are shown in Table 2 below.

TABLE 2

| | Comparative Example | | | | |
|---|---|---|---|---|---|
| | 1 | 2 | 3 | 4 | 5 |
| Type of resin | PBT(2) | PBT | N-612(3) | N-612 | PBT |
| Amount of C.B.(1) (parts) | 4 | 6 | 7 | 9 | 10 |
| Temperature of orientation vessel (°C.) | 185 | 185 | 180 | 180 | 185 |
| Specific volume resistivity of monofilament (Ohm-cm) | above $10^{15}$ | above $10^{15}$ | above $10^{15}$ | above $10^{15}$ | $3.5 \times 10^{9}$ |

(1), (2), (3): Please refer to the footnotes in Table 1.

EXAMPLES 5–11 AND COMPARATIVE EXAMPLES 6–8

One hundred parts of Nylon 610 having a melting point of 215° C. was compounded with 11 parts of a commercially available electrically conductive furnace black having a DBP oil absorption amount of 350 ml/100 g. The resultant composition was kneaded in a dual worm extruder to form pellets. The pellets thus obtained were formed into a monofilament in the steps shown in FIG. 3 under the conditions listed in Table 3 below. Thus, monofilaments having a diameter of 0.8 mm were obtained.

A specific volume resistivity representing an electrical conductivity was determined. The results as well as the forming conditions of the monofilaments are shown in Table 3 below.

In the case where the temperature of the monofilament during orientation was 215° C. (i.e. the melting point of Nylon 610), a monofilament could not be formed.

were obtained. The specific volume resistivity of each monofilament was determined.

The results are shown in Table 4 below.

TABLE 4

| Comparative Example | Orientation conditions other than orientation temperature | | Specific volume resistivity (Ohm-cm) |
|---|---|---|---|
| 9 | Same as in Example | 5 | $3.8 \times 10^{13}$ |
| 10 | Same as in Example | 6 | $5.2 \times 10^{13}$ |
| 11 | Same as in Example | 7 | $3.2 \times 10^{14}$ |
| 12 | Same as in Example | 8 | $6.1 \times 10^{14}$ |
| 13 | Same as in Example | 9 | $7.0 \times 10^{14}$ |
| 14 | Same as in Example | 10 | $7.2 \times 10^{14}$ |
| 15 | Same as in Example | 11 | $9.6 \times 10^{14}$ |
| 16 | Same as in Comparative Example | 6 | $3.4 \times 10^{15}$ |
| 17 | Same as in Comparative Example | 7 | $1.8 \times 10^{15}$ |
| 18 | Same as in Comparative Example | 8 | $4.1 \times 10^{15}$ |

As is clear from the results shown in Table 4 above, no monofilament having a good electrical conductivity was obtained when the temperature of the monofilament during the orientation was 130° C.

EXAMPLES 12–18 AND COMPARATIVE EXAMPLES 19–21

One hundred parts of poly(butylene terephthalate) having a melting point of 220° C. was compounded with 8.7 parts of a commercially available electrically conductive furnace carbon black having a DBP oil absorption amount of 350 ml/100 g. The resultant composition was kneaded in a dual worm extruder to form pellets.

The pellets thus obtained were formed into monofilaments in the steps shown in FIG. 3. The monofilaments were orientated under predetermined conditions to form orientated monofilaments having a diameter of 0.8 mm.

TABLE 3

| | | Stretching strain rate (%/min) | Length of orientation vessel (m) | Stretching ratio | Stretching speed (m/min) | Specific volume resistivity (ohm-cm) 170° C.(1) | 190° C.(1) | 210° C.(1) |
|---|---|---|---|---|---|---|---|---|
| Example | 5 | 100 | 8 | 6 | 1.6 | $1.8 \times 10^{5}$ | $6.4 \times 10^{3}$ | $2.1 \times 10^{3}$ |
| | 6 | 500 | 8 | 6 | 8 | $5.1 \times 10^{6}$ | $1.9 \times 10^{4}$ | $3.0 \times 10^{3}$ |
| | 7 | 1,000 | 6 | 5 | 15 | $8.0 \times 10^{7}$ | $6.5 \times 10^{5}$ | $7.9 \times 10^{3}$ |
| | 8 | 2,000 | 5 | 5 | 25 | $7.1 \times 10^{8}$ | $3.5 \times 10^{6}$ | $1.3 \times 10^{5}$ |
| | 9 | 3,480 | 5 | 4 | 58 | $9.0 \times 10^{10}$ | $8.7 \times 10^{8}$ | $9.8 \times 10^{6}$ |
| | 10 | 4,000 | 6 | 4 | 80 | $3.3 \times 10^{11}$ | $1.8 \times 10^{10}$ | $5.5 \times 10^{8}$ |
| | 11 | 5,000 | 6 | 4 | 100 | $1.6 \times 10^{12}$ | $7.2 \times 10^{11}$ | $9.6 \times 10^{10}$ |
| Comparative Example | 6 | 6,000 | 5 | 4 | 100 | $2.6 \times 10^{14}$ | $9.1 \times 10^{13}$ | $9.2 \times 10^{13}$ |
| | 7 | 10,020 | 5 | 4 | 167 | $1.1 \times 10^{15}$ | $2.8 \times 10^{14}$ | $9.4 \times 10^{13}$ |
| | 8 | 30,000 | 3 | 6 | 180 | $9.2 \times 10^{15}$ | $5.5 \times 10^{14}$ | $1.3 \times 10^{14}$ |

(1)Temperature of monofilament during orientation

COMPARATIVE EXAMPLES 9–18

The procedures in Examples 5–12 and Comparative Examples 6–8 were used in Comparative Examples 9–18, respectively, except that the temperature of the monofilament during orientation was changed to 130° C. Thus, monofilaments having a diameter of 0.8 mm The specific volume resistivity was determined in the same manner as in Example 1. The forming conditions and the results of the specific volume resistivity of the monofilaments are shown in Table 5 below.

In the case where the temperature of the monofilament during orientation was 220° C. [i.e. the melting point of poly(butylene terephthalate)], no monofilament was formed.

TABLE 5

| | | Stretching strain rate (%/min) | Length of orientation vessel (m) | Stretching ratio | Stretching velocity (m/min) | Specific volume resistivity (Ohm-cm) 180° C.(1) | 210° C.(1) |
|---|---|---|---|---|---|---|---|
| Example | 12 | 100 | 8 | 6 | 1.6 | $1.4 \times 10^{6}$ | $3.0 \times 10^{4}$ |

TABLE 5-continued

| | | Stretching strain rate (%/min) | Length of orientation vessel (m) | Stretching ratio | Stretching velocity (m/min) | Specific volume resistivity (Ohm-cm) 180° C.(1) | 210° C.(1) |
|---|---|---|---|---|---|---|---|
| | 13 | 500 | 8 | 6 | 8 | $7.5 \times 10^6$ | $8.1 \times 10^4$ |
| | 14 | 1,000 | 6 | 5 | 15 | $3.9 \times 10^8$ | $1.2 \times 10^6$ |
| | 15 | 2,000 | 5 | 5 | 25 | $2.2 \times 10^9$ | $4.8 \times 10^7$ |
| | 16 | 3,480 | 5 | 4 | 58 | $8.2 \times 10^{10}$ | $4.0 \times 10^9$ |
| | 17 | 4,000 | 6 | 4 | 80 | $1.8 \times 10^{11}$ | $6.2 \times 10^{10}$ |
| | 18 | 5,000 | 6 | 4 | 100 | $6.2 \times 10^{12}$ | $4.3 \times 10^{11}$ |
| Comparative | 19 | 6,000 | 5 | 4 | 100 | $9.8 \times 10^{13}$ | $1.2 \times 10^{13}$ |
| Example | 20 | 10,020 | 5 | 4 | 167 | $4.0 \times 10^{14}$ | $3.1 \times 10^{14}$ |
| | 21 | 30,000 | 3 | 6 | 180 | $9.1 \times 10^{14}$ | $6.5 \times 10^{14}$ |

(1)Temperature of monofilament during orientation

COMPARATIVE EXAMPLES 22–31

The procedures in Examples 12–18 and Comparative Examples 19–21 were used in Comparative Examples 22–31, respectively, except that the temperature of the monofilament during orientation was changed to 150° C. Thus, monofilaments having a diameter of 0.8 mm were obtained. The specific volume resistivity of each monofilament was obtained.

The results are shown in Table 6 below.

TABLE 6

| Comparative Example | Conditions other than orientation temperature | | Specific volume resistivity (Ohm-cm) |
|---|---|---|---|
| 22 | Same as in Example | 12 | $3.3 \times 10^{13}$ |
| 23 | Same as in Example | 13 | $1.1 \times 10^{14}$ |
| 24 | Same as in Example | 14 | $9.2 \times 10^{14}$ |
| 25 | Same as in Example | 15 | $8.1 \times 10^{14}$ |
| 26 | Same as in Example | 16 | $1.0 \times 10^{15}$ |
| 27 | Same as in Example | 17 | $9.8 \times 10^{14}$ |
| 28 | Same as in Example | 18 | $8.2 \times 10^{14}$ |
| 29 | Same as in Comparative Example | 19 | $1.1 \times 10^{15}$ |
| 30 | Same as in Comparative Example | 20 | $1.3 \times 10^{15}$ |
| 31 | Same as in Comparative Example | 21 | $1.6 \times 10^{15}$ |

As is clear from the above results, in the case where the temperature of monofilament during orientation was 150° C., which temperature was by more than 60° C. lower than the melting point, no monofilament having a good electrical conductivity was obtained.

We claim:

1. A process for producing an electrically conductive thermoplastic resin monofilament containing an electrically conductive carbon black through extrusion, cooling, and orientation steps, wherein the temperature of the monofilament in the orientation step is within the range of from 60° C. less than to 5° C. less than the melting point of the thermoplastic resin, and orientation is carried out at a stretching strain rate of 5000%/min or less.

2. A process as claimed in claim 1, wherein an aging step, in which the temperature of the monofilament is kept constant at a temperature of from 50° C. less than to 5° C. less than the melting point of the thermoplastic resin, is carried out between the cooling step and the orientation step.

3. The process as claimed in claim 2, wherein the temperature of the aging step and the orientation step are substantially identical to each other.

* * * * *